US009145905B2

(12) United States Patent
Hou

(10) Patent No.: US 9,145,905 B2
(45) Date of Patent: Sep. 29, 2015

(54) INDEPENDENT LOAD SENSING FOR A VEHICLE HYDRAULIC SYSTEM

(71) Applicant: Oshkosh Corporation, Oshkosh, WI (US)

(72) Inventor: Yanming Hou, Pleasant Prairie, WI (US)

(73) Assignee: Oshkosh Corporation, Oshkosh, WI (US)

( * ) Notice: Subject to any disclaimer, the term of this patent is extended or adjusted under 35 U.S.C. 154(b) by 407 days.

(21) Appl. No.: 13/837,447

(22) Filed: Mar. 15, 2013

(65) Prior Publication Data

US 2014/0271066 A1 Sep. 18, 2014

(51) Int. Cl.

| | |
|---|---|
| ***F15B 11/17*** | (2006.01) |
| ***B65F 3/06*** | (2006.01) |
| *B65F 3/20* | (2006.01) |

(52) U.S. Cl.

CPC . *F15B 11/17* (2013.01); *B65F 3/06* (2013.01); *B65F 3/20* (2013.01); *B65F 2210/168* (2013.01); *F15B 2211/20546* (2013.01); *F15B 2211/20576* (2013.01); *F15B 2211/31535* (2013.01); *F15B 2211/605* (2013.01); *F15B 2211/7142* (2013.01)

(58) Field of Classification Search

CPC ..... F15B 11/17; E02F 9/2292; B65F 3/06; B65F 3/20

USPC ..... 60/420, 421, 422

See application file for complete search history.

(56) References Cited

U.S. PATENT DOCUMENTS

| | | | | |
|---|---|---|---|---|
| 4,967,557 | A | 11/1990 | Izumi et al. | |
| 4,977,928 | A | 12/1990 | Smith et al. | |
| 5,579,642 | A | 12/1996 | Wilke et al. | |
| 5,692,377 | A * | 12/1997 | Moriya et al. | 60/421 |
| 5,715,865 | A | 2/1998 | Wilke | |
| 6,318,079 | B1 | 11/2001 | Barber | |
| 6,752,600 | B2 | 6/2004 | Worthington | |
| 7,059,125 | B2 * | 6/2006 | Oka et al. | 60/422 |
| 7,070,381 | B2 * | 7/2006 | Khan et al. | 414/408 |
| 7,559,734 | B2 | 7/2009 | Khan et al. | |
| 9,016,052 | B2 * | 4/2015 | Cho | 60/420 |
| 2001/0036413 | A1 * | 11/2001 | McFadden et al. | 417/286 |
| 2012/0216871 | A1 * | 8/2012 | Hindman et al. | 137/1 |
| 2013/0146162 | A1 | 6/2013 | Coolidge | |

FOREIGN PATENT DOCUMENTS

EP 0 894 739 A1 2/1999

OTHER PUBLICATIONS

Eaton Medium Duty Piston Pumps, Load Sensing Systems Principle of Operation, No. 03-206, Nov. 1992, 28 pages.

Parker Haudraulic Pump Basics Presentation, Hydraulic Pump Purpose: Provide the Flow needed to transmit power from a prome mover to a hydraulic actuator, 65 pages, 2010.

* cited by examiner

*Primary Examiner* — Thomas E Lazo

(74) *Attorney, Agent, or Firm* — Foley & Lardner LLP

(57) ABSTRACT

A hydraulic system for a vehicle includes a first hydraulic circuit, a second hydraulic circuit, and a main actuator. The first hydraulic circuit includes a first pump having a flow outlet; a first pressure line having a pump end coupled to the flow outlet of the first pump; and a first load sensing line having a pump end coupled to the first pump and a pressure end coupled to the first pressure line. The second hydraulic circuit includes a second pump having a flow outlet; a second pressure line having a pump end coupled to the flow outlet of the second pump; and a second load sensing line having a pump end coupled to the second pump and a pressure end coupled to the second pressure line. The main actuator is coupled to the first pressure line and the second pressure line and is configured to oppose a load force. The first load sensing line is separate from the second load sensing line such that the first pump and the second pump respond independently to the load force.

20 Claims, 5 Drawing Sheets

INDEPENDENT LOAD SENSING FOR A VEHICLE HYDRAULIC SYSTEM

BACKGROUND

The present invention relates generally to the field of vehicle hydraulic systems. The present invention relates more specifically to a load sensing system for vehicle hydraulic system including multiple hydraulic pumps and multiple actuators.

Hydraulic systems typically include a pressure source (e.g., a hydraulic pump), a hydraulic circuit through which the pressurized fluid is transported, and one or more devices (e.g., hydraulic cylinders, hydraulic motors, etc.) in which the pressure is used to do work. Flow of hydraulic fluid to the device may be controlled with a valve in the hydraulic circuit. The hydraulic pump may be a fixed displacement hydraulic pump that provides a fixed flow rate of hydraulic fluid. Because the hydraulic system may include several devices and more than one of the devices may be operated simultaneously using the pressurized hydraulic fluid, the pump is typically sized to provide a flow rate and pressure that is sufficient to run all or a number of the devices simultaneously. However, if only one device is operated with the hydraulic pump providing an excessive flow rate and pressure, excess pressure accumulates in the hydraulic circuit. To prevent damage to the components of the hydraulic system, a high pressure relief valve may be provided in the hydraulic circuit which allows excess hydraulic fluid to pass through the system (e.g., to a fluid reservoir). However, the hydraulic pump consumes excessive energy to provide a high fluid flow rate, the excess energy being converted to heat that can shorten the system life and jeopardize system function.

In current refuse industry vehicles, the hydraulic systems may include multiple hydraulic pumps working together to provide the pressure and flow rate required by several devices such as hydraulic actuators, with the flow to each of the devices controlled through valves in the hydraulic circuit. The hydraulic source used may be variable displacement hydraulic pumps with a pressure compensating load sensing system to regulate the output of the source and provide hydraulic fluid at a desired flow rate and pressure to match the varying demand of the multiple devices. The load sensing signals, the flow, or both are typically combined before the control valves.

When performing refuse collection functions, the working load faced by one valve from the associated actuator will likely affect both pumps. If a high load is sensed at one valve, the pressure in the system is increased to compensate and the other valves operate under unnecessarily high pressures, reducing the energy efficiency of the hydraulic system and potentially causing undesired, erratic movement of the actuators. In some cases, the unnecessarily high pressure can prevent normal performance of the system or contribute to the premature failure of components of the hydraulic system. When the load sense and flow are combined between pumps and the valves, one pump may become saturated before the other pump begins operating. One pump may work constantly while another pump only works intermittently. Flow limiters may be added to prevent one pump from operating excessively, but this adds cost and complexity to the hydraulic system. Further, the combined load sensing typically may amplify the load shocks and pressure spikes in the hydraulic system. This amplification can cause erratic or jerky movement of the actuators and accelerate premature failure of the components of the hydraulic system.

SUMMARY

One embodiment of the invention relates to a hydraulic system for a vehicle, the hydraulic system including a first hydraulic circuit, a second hydraulic circuit, and a main actuator. The first hydraulic circuit includes a first pump having a flow outlet; a first pressure line having a pump end coupled to the flow outlet of the first pump; and a first load sensing line having a pump end coupled to the first pump and a pressure end coupled to the first pressure line. The second hydraulic circuit includes a second pump having a flow outlet; a second pressure line having a pump end coupled to the flow outlet of the second pump; and a second load sensing line having a pump end coupled to the second pump and a pressure end coupled to the second pressure line. The main actuator is coupled to the first pressure line and the second pressure line and is configured to oppose a load force. The first load sensing line is separate from the second load sensing line such that the first pump and the second pump respond independently to the load force.

Another embodiment of the invention relates to a hydraulic system for a vehicle, the hydraulic system including a plurality of pumps configured to provide a pressurized fluid including a first pump and a second pump. The hydraulic system further includes a plurality of pressure lines including a first pressure line coupled to the first pump and defining a first flow path and a second pressure line coupled to the second pump and defining a second flow path. The hydraulic system further includes a plurality of load sensing lines including a first load sensing line and a second load sensing line; a main actuator in fluid communication with the first pressure line and the second pressure line; a plurality of control valves including a first control valve disposed along the first flow path and a second control valve disposed along the second flow path; and a union coupling the first pressure line to the second pressure line. The union is positioned along the first flow path and the second flow path between the plurality of control valves and the main actuator thereby reducing hydraulic competition between the first pump and the second pump.

Yet another embodiment of the invention relates to a vehicle including a chassis; a driver coupled to the chassis, a first hydraulic circuit coupled to the chassis, a second hydraulic circuit coupled to the chassis, and a main actuator. The first hydraulic circuit includes a first pump coupled to the driver and having a flow outlet; a first pressure line having a pump end coupled to the flow outlet of the first pump; and a first load sensing line having a pump end coupled to the first pump and a pressure end coupled to the first pressure line. The second hydraulic circuit includes a second pump coupled to the driver and having a flow outlet; a second pressure line having a pump end coupled to the flow outlet of the second pump; and a second load sensing line having a pump end coupled to the second pump and a pressure end coupled to the second pressure line. The main actuator is coupled to the first pressure line and the second pressure line and configured to oppose a load force. The first load sensing line is separate from the second load sensing line such that the first pump and the second pump respond independently to the load force.

The invention is capable of other embodiments and of being carried out in various ways. Alternative exemplary embodiments relate to other features and combinations of features as may be recited in the claims.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1A:
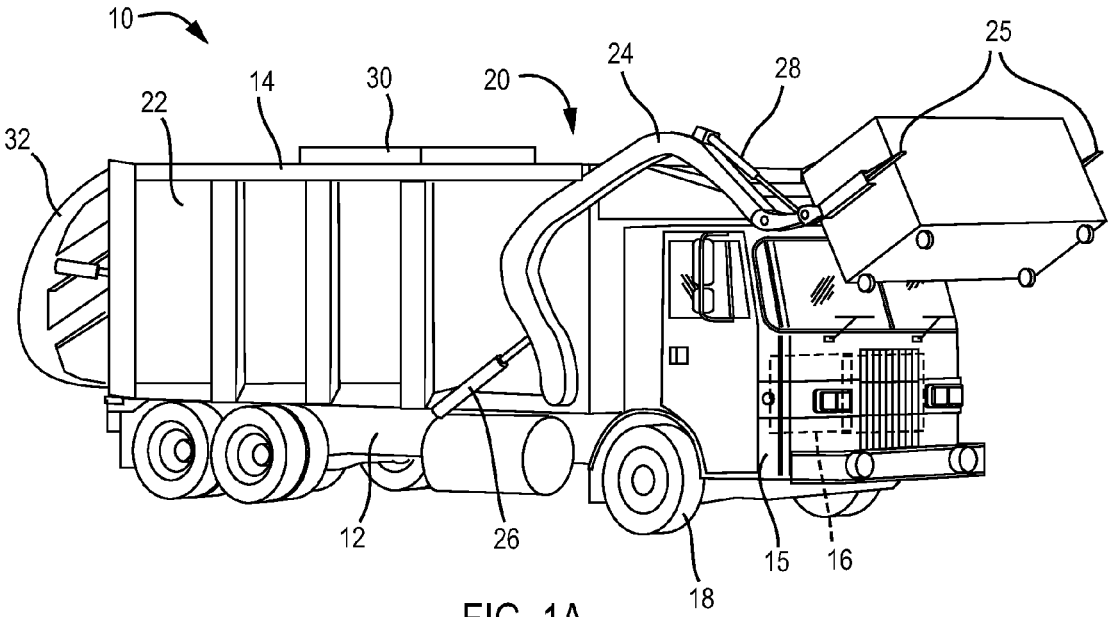
FIG. 1A is an isometric view of a vehicle including a hydraulic system, according to an exemplary embodiment.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring to FIGS. 1A-1E, a vehicle is shown according to several exemplary embodiments as a refuse truck 10 (e.g., garbage truck, waste collection truck, sanitation truck). The refuse truck 10 includes a chassis, shown as a frame 12, and a body 14 coupled to the frame 12. The body includes an operator's compartment or cab 15. The refuse truck 10 further includes a driver, shown as an internal combustion engine 16 mounted at the front of the frame 12. The engine 16 provides power to wheels 18 and to other systems of the vehicle. According to various exemplary embodiments, the engine 16 may be configured to utilize a variety of fuels, including gasoline, diesel, bio-diesel, ethanol, natural gas, etc. According to other exemplary embodiments, the driver may be another device coupled to the frame 12 such as one or more electric motors capable of providing power to the systems of the vehicle 10. The motors may consume electrical power from an on-board storage device (e.g., batteries, ultra-capacitors, etc.), from an on-board generator (e.g., an internal combustion engine), or an external power source (e.g., overhead power lines).

The refuse truck 10 is configured to collect and transport refuse, such as from waste receptacles (e.g., cans, bins, containers) from a collection area, such as on the side of the road or in an alley. The body 14 includes sidewalls 22 defining a collection chamber, shown as a compartment 20 (e.g., hopper) in the rear of the refuse truck 10. Refuse may be deposited in the compartment 20 for transport to a waste disposal site such as a landfill or recycling facility.

Referring to FIG. 1A, the refuse truck 10 is shown according to an exemplary embodiment as a front-loading truck including moveable arms 24 coupled to the frame 12 on either side of the cab 15. Interface members such as forks 25 are coupled to the arms 24 and are configured to engage a refuse container. After the forks 25 have engaged a refuse container, the arms 24 are rotated about an axis by a set of actuators, shown as hydraulic cylinders 26, to lift the refuse container over the cab 15 of the vehicle. The forks 25 may then be articulated with another set of actuators, shown as hydraulic cylinders 28, to tip the refuse out of the container and into the compartment 20. The forks 25 and the arms 24 are then articulated to return the empty container to the ground. After receiving the refuse, the top of the compartment may be closed with a top door 30 to prevent refuse from escaping through the top of the compartment 20.

Figure 1B:
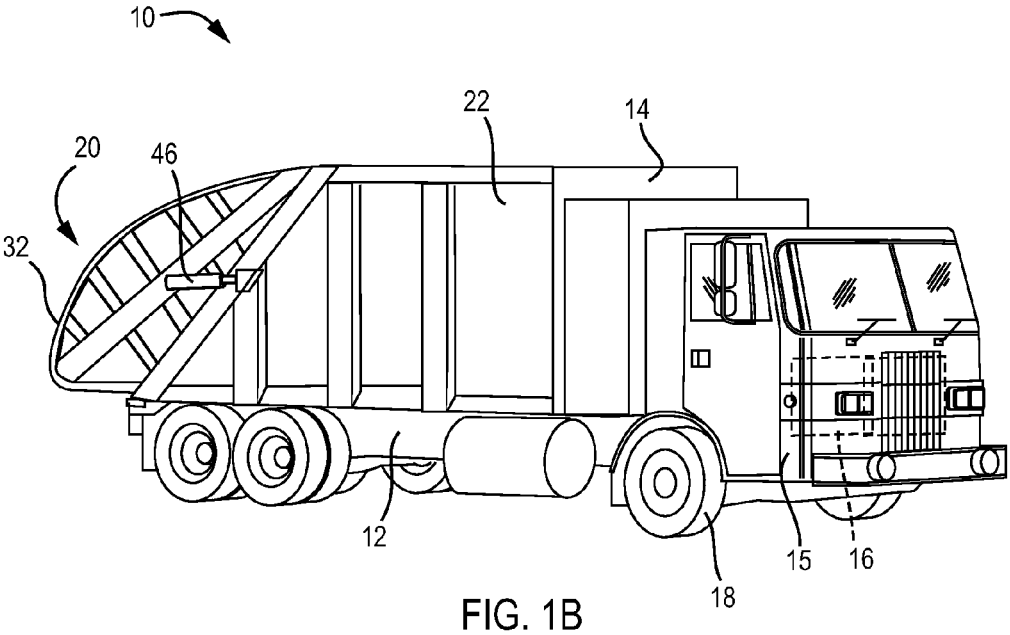
FIG. 1B is an isometric view of a vehicle including a hydraulic system, according to an exemplary embodiment.

Referring to FIG. 1B, the refuse truck 10 is shown according to another exemplary embodiment as a rear-loading truck. Refuse containers may be emptied into the back of the compartment 20 through an opening in a tailgate 32. The refuse may either be emptied into the compartment 20 manually or with a mechanically assisted system (e.g., arms similar to the arms 24 described above, a chain or cable tipping system, etc.).

Figure 1C:
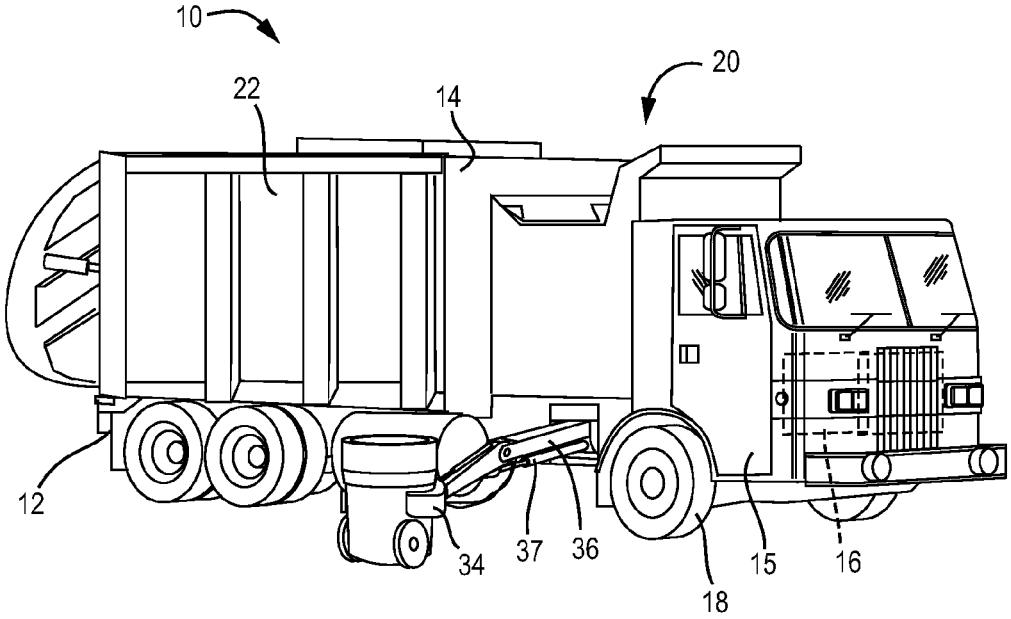
FIG. 1C is an isometric view of a vehicle including a hydraulic system, according to an exemplary embodiment.
Figure 1D:
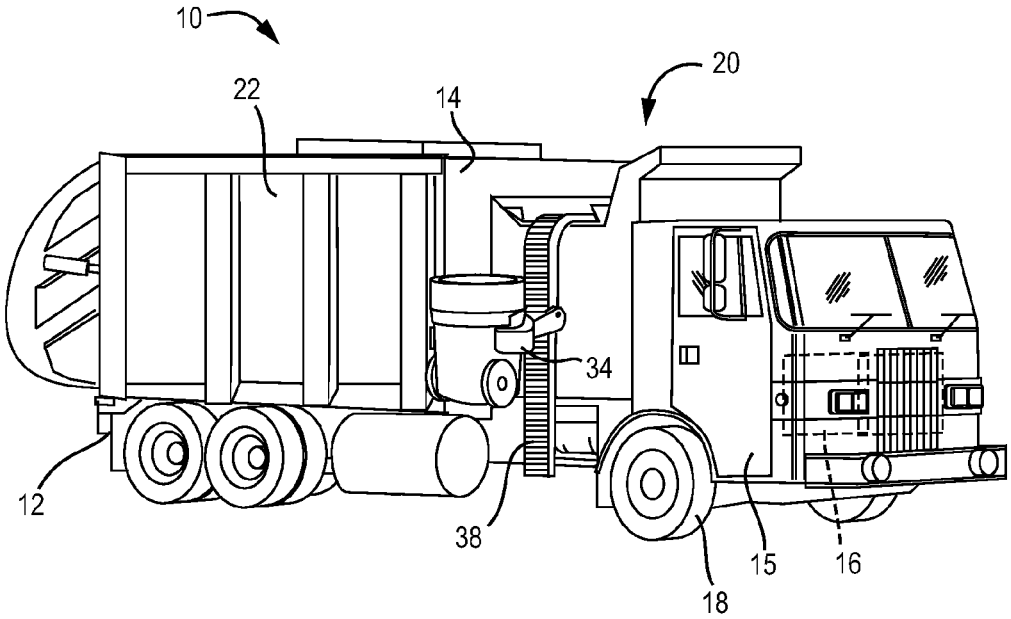
FIG. 1D is an isometric view of a vehicle including a hydraulic system, according to an exemplary embodiment.

Referring to FIGS. 1C and 1D, the refuse truck 10 is shown according to another exemplary embodiment as a side-loading truck including a grabber 34 configured to interface with the refuse container. According to one embodiment, shown in FIG. 1C, the grabber 34 may be provided at the end of an arm 36. The arm 36 is moveable through the use of actuators, such as hydraulic cylinders 37. The arm may be moveable in multiple directions (e.g., up/down, left/right, in/out, rotation, etc.) to facilitate the grabbing of the refuse container. According to another exemplary embodiment, the grabber 34 may be coupled to a moveable track 38. After the grabber 34 has engaged a refuse container, the grabber 34 is moved by the arm 36 or the track 38 to lift the refuse container over one of the sidewalls 22 and tipped to empty the refuse out of the container and into the compartment 20 through an opening in the top. The arm 36 or the track 38 may then be moved to return the empty container to the ground. After receiving the refuse, the top of the compartment 20 may be closed with a top door 30 to prevent refuse from escaping through the top of the compartment 20.

Figure 1E:
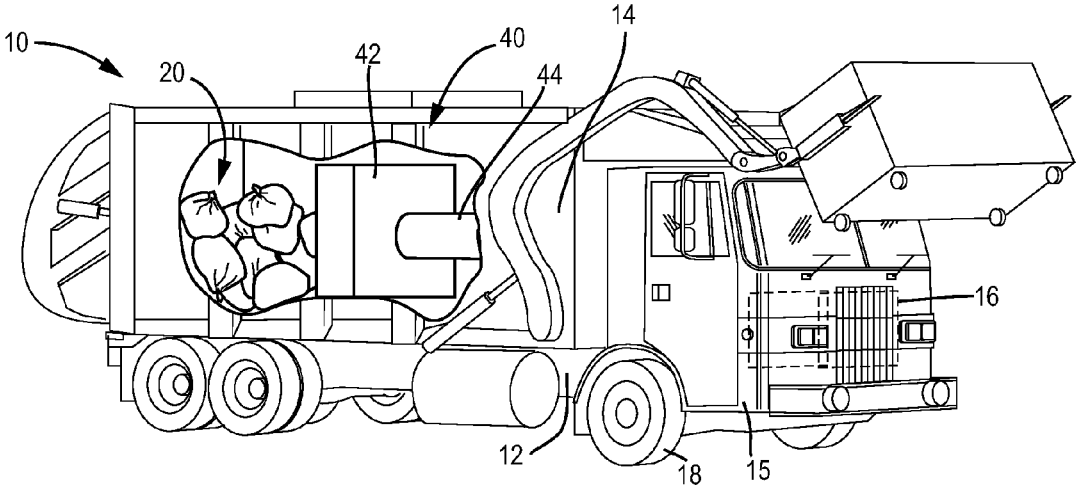
FIG. 1E is a schematic side view of a vehicle including a hydraulic system, according to an exemplary embodiment.

According to an exemplary embodiment shown in FIG. 1E, the refuse truck 10 includes a packer 40 (e.g., press, compactor, etc.) disposed within the compartment 20. The packer 40 is configured to compact the refuse within the compartment 20. According to an exemplary embodiment, the packer 40 is a hydraulic system including a ram 42 driven by an actuator, such as a hydraulic cylinder 44. The hydraulic cylinder forces the ram 42 against the refuse in the compartment 20, compressing the refuse against another structure, such as an interior wall of the compartment 20. The packer 40 may compact the refuse towards the front of the compartment 20 (e.g., for a rear-loading truck), or towards the back of the compartment 20 (e.g., for a front-loading or side-loading truck). According to other exemplary embodiments, the packer 40 may be another mechanism, such as a screw mechanism configured to process (e.g., compact, shred, etc.) the refuse within the compartment 20.

According to an exemplary embodiment, the portion of the body 14 forming the compartment 20 may be rotated or tipped to empty refuse from the compartment 20 into another receptacle or collection area. According to an exemplary embodiment, the body 14 is tipped backwards (e.g., towards the tailgate 32 with a hydraulic actuator (e.g., lift cylinders, dump cylinders, raise cylinders, etc.). The tailgate 32 may simultaneously be rotated to open the rear of the body with an actuator, shown in FIG. 1B as a set of hydraulic cylinders 46. According to other exemplary embodiments, the body 12 may remain stationary and the tailgate 32 may be lifted to allow the refuse to be pushed out of the compartment 20 from within.

Figure 2:
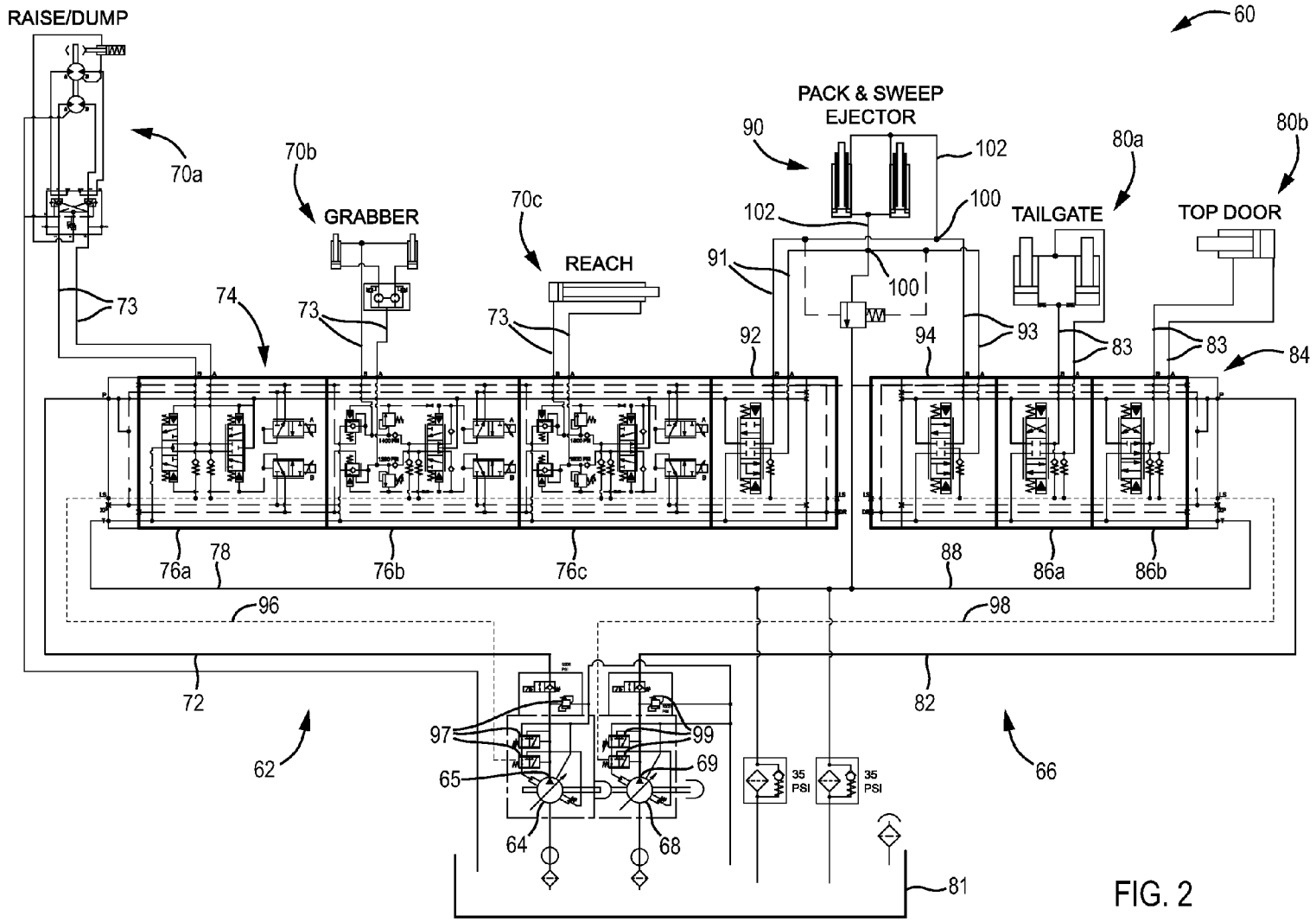
FIG. 2 is a schematic diagram of a hydraulic system for a vehicle, according to an exemplary embodiment.

Referring now to FIG. 2, a hydraulic system 60 is shown according to an exemplary embodiment. The hydraulic system 60 includes a first hydraulic circuit 62 with a first prime mover, shown as a first hydraulic pump 64, and a second hydraulic circuit 66 with a second prime mover, shown as a second hydraulic pump 68. According to an exemplary embodiment, the first hydraulic pump 64 and the second hydraulic pump 68 draw hydraulic fluid from a common reservoir 81 (e.g., tank). According to an exemplary embodiment, the first hydraulic pump 64 and the second hydraulic pump 68 are variable displacement pumps.

The flow outlet 65 of the first hydraulic pump 64 is coupled to one or more devices, shown as actuators 70*a*-70*c*, via a first pressure line 72 (e.g., high pressure line). A first valve block 74 includes a multitude of valves 76*a*-76*c* configured to control the flow of pressurized fluid to the actuators 70*a*-70*c* from the pressure line 72 and from the actuators 70*a*-70*c* to the reservoir 81 via a first return line 78 (e.g., low pressure line). According to an exemplary embodiment, the actuators 70*a-c* operate at between 500-1500 psi. According to a preferred exemplary embodiment, the actuators 70*a-c* operate at approximately 1000 psi.

The flow outlet 69 of the second hydraulic pump 68 is coupled to one or more devices, shown as actuators 80*a*-80*b*, via a second pressure line 82 (e.g., high pressure line). A second valve block 84 includes a multitude of valves 86*a*-86*b* configured to control the flow of pressurized fluid to the actuators 80*a*-80*b* from the pressure line 82 and from the actuators 80*a*-80*b* to the reservoir 81 via a second return line 88 (e.g., low pressure line). According to an exemplary embodiment, the actuators 80*a-b* operate at between 1500-2500 psi. According to a preferred exemplary embodiment, the actuators 80*a-b* operate at approximately 2000 psi.

According to an exemplary embodiment, the actuators 70*a*-70*c* and 80*a*-80*b* may be smaller capacity actuators, such as the hydraulic cylinders 26 for the front arms 24, the hydraulic cylinders 46 for the tailgate 32, the hydraulic cylinder for the top door 30, the hydraulic cylinders 37 for the side load arm 36, or the actuators for the grabber 34.

According to an exemplary embodiment, the hydraulic system 60 further includes a main actuator, shown as an actuator 90, that is coupled to both the first hydraulic circuit 62 and the second hydraulic circuit 66. The actuator 90 is coupled to the first hydraulic circuit 62 (e.g., the first pressure line 72) via a first valve 92 and is coupled to the second hydraulic circuit 66 (e.g., the second pressure line 82) via a second valve 94. According to an exemplary embodiment, the first valve 92 is provided as a part of the first valve block 74 and the second valve 94 is provided as part of the second valve block 84. The actuator 90 may be configured to oppose a load force that exceeds the maximum output capabilities (e.g., maximum pressure, maximum flow rate, etc.) of either the first hydraulic pump 64 or the second hydraulic pump 68. For example, the actuator 90 may be a high volume actuator such as the hydraulic cylinder 44 for the packer 40, where the actuator 90 opposes the load force of the refuse to be compacted.

The hydraulic system 60 further includes a load sensing system to monitor the load on the hydraulic system and provide a feedback independently to the first hydraulic pump 64 and the second hydraulic pump 68. A first load sensing line 96 is coupled between the first pressure line 72 and the first hydraulic pump 64. A second load sensing line 98 is coupled between the second pressure line 82 and the second hydraulic pump 68. The first load sensing line 96 and the second load sensing line 98 provide a feedback passage from the high pressure line back to the first hydraulic pump 64 and the second hydraulic pump 68, respectively. The first load sensing line 96 is coupled to control valves 97 (e.g., flow compensator, pressure compensator) that are coupled to the first hydraulic pump 64 and control the output of the first hydraulic pump 64 (e.g., by varying the angle of the camplate). The second load sensing line 98 is coupled to control valves 99 (e.g., flow compensator, pressure compensator) that are coupled to the first hydraulic pump 64 and control the output of the first hydraulic pump 64 (e.g., by varying the angle of the camplate). If an increased load is experienced in the high pressure line, it is sensed by the respective hydraulic pump via the load sensing line. The hydraulic pump output is then increased to compensate for the increased load.

According to an exemplary embodiment, the first load sensing line 96 is coupled to the branches 73 of the first pressure line 72 downstream from each of the control valves 76. The second load sensing line 98 is likewise coupled to the branches 83 of the second pressure line 82 downstream from each of the control valves 86.

The first hydraulic pump 64 and the second hydraulic pump 68 are generally isolated from each other. A fluctuation in the load on any of the actuators 70*a-c* as is sensed by the first load sensing line 96 to vary the output of the first hydraulic pump 64. A fluctuation in the load on any of the actuators 80*a-b* as is sensed by the second load sensing line 98 to vary the output of the second hydraulic pump 68. In either scenario, the first hydraulic pump 64 and the second hydraulic pump 68 are free to operate independent of each other. For example, if one of the actuators 80*a-b* encounters an elevated load and requires additional energy at a high pressure (e.g., approximately 2000 psi), only the output of the second hydraulic pump 68 is increased. The first hydraulic pump 64 is free to operate with an output tuned to the requirements of the actuators 70*a-c* of the first hydraulic circuit 62 at a lower pressure (e.g. approximately 1000 psi) without trying to match the output of the second hydraulic pump 68, the resulting difference in power which would be converted into waste heat.

The majority of the hydraulic functions of the hydraulic system 60, including those of the actuators 70*a-c* and the actuators 80*a-b*, are powered by just one of the hydraulic pumps 64 and 68. During a large majority of the operation of the refuse truck 10, only one of the actuators in each of the first hydraulic circuit 62 and the second hydraulic circuit 66 are operated at a time. The first hydraulic pump 64 may be configured to have a maximum output that is sufficient to operate each of the actuators 70*a-c* in the first hydraulic circuit 62 simultaneously and the second hydraulic pump may be configured to have a maximum output that is sufficient to operate each of the actuators 80*a-b* in the second hydraulic circuit 66 simultaneously.

The main actuator 90 may require a flow rate that exceeds the maximum flow rate of both the first hydraulic pump 64 on its own and the second hydraulic pump 68 on its own. According to an exemplary embodiment, the actuators 70*a-c* and the actuators 80*a-b* may have a maximum travel of approximately 6 feet, while the main actuator 90 may have a maximum travel of approximately 30-35 feet. The outputs of the pumps 64 and 68 may therefore be joined to provide a sufficient flow rate to the main actuator 90. According to an exemplary embodiment, the main actuator 90 is coupled to the first hydraulic circuit 62 via branches 91 and to the second hydraulic circuit 66 via branches 93. Unions 100 are provided between the valves 92 and 94 and the main actuator 90, with each union 100 having an inlet for one of the branches 91 of the first pressure line 72 and one of the branches 93 of the second pressure line 82. The unions 100 are each include an outlet coupled to the main actuator 90 via a common pressure line 102.

Figure 3:
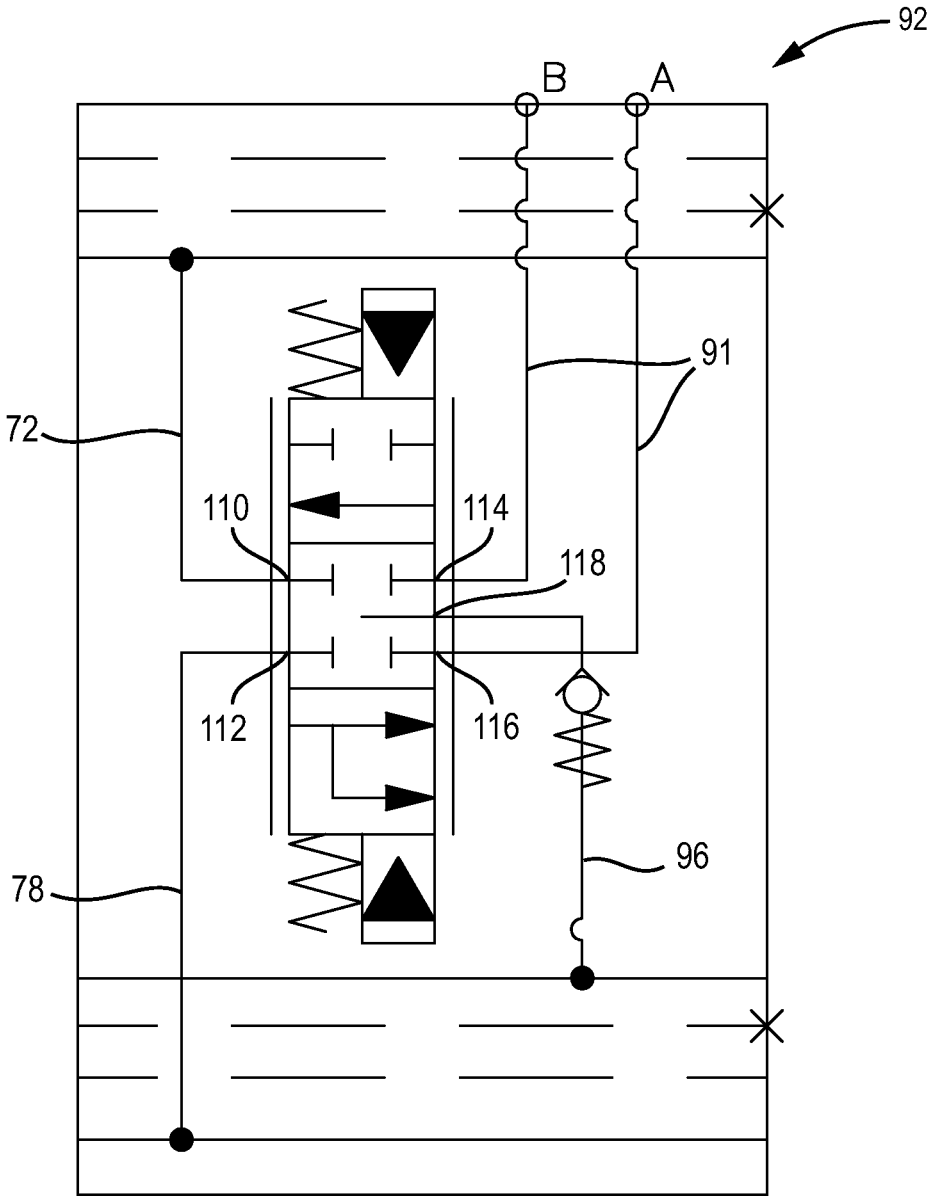
FIG. 3 is schematic diagram of a control valve for the hydraulic system of FIG. 2, according to an exemplary embodiment.

Referring now to FIG. 3, the valve 92 is shown in greater detail. The valve 92 is a bi-directional valve with a first orifice or port 110 coupled to the first high pressure line 72, a second orifice or port 112 coupled to the first return line 78, a third orifice or port 114 coupled to one of the branches 91, and a fourth orifice or port 116 coupled to the other branch 91. According to an exemplary embodiment, the main actuator 90 is a linear actuator with an extension chamber and a compression chamber. The valve 92 is moveable to direct pressurized fluid from the first pressure line 72 to one of the branches 91 and direct fluid from the other branch 91 to the first return line 78. One of the branches 91 is coupled to the extension chamber of the main actuator 90 while the other branch 91 is coupled to the compression chamber of the main actuator 90. According to an exemplary embodiment, the valve 92 is movable to a neutral position in which pressurized fluid from the first pressure line 72 is not directed to either of the branches 91. The first load sensing line 96 is coupled the valve 92 at a fifth orifice or port 118. The fifth port 118 is disposed along the flow path of the fluid between the first hydraulic pump 64 and the main actuator 90 between the first orifice and the main actuator 90. The second valve 94 is similar in construction to the first valve 92.

The load from the actuator 90 in the first pressure line 72 is sensed by the first load sensing line 96 independently compared to the load from the actuator 90 in the second pressure line 82 sensed by the second load sensing line 98. By joining the first pressure line 72 and the second pressure line 82 at unions 100 downstream of the valves 92 and 94 and downstream of the respective load sensing lines 96 and 98, the first pressure line 72 and the second pressure line 82 (and the loads as detected by the respective load sensing lines 96 and 98) are isolated from each other. The load from the main actuator 90 on the first hydraulic circuit 62 and the second hydraulic circuit 66 is therefore sensed independently for the first hydraulic pump 64 and the second hydraulic pump 68, minimizing cross-talk between the hydraulic pumps 64 and 68. The change in output of either the first hydraulic pump 64 or the second hydraulic pump 68 will not result in a change in output of the other pump as would be the case for two pumps attempting to compensate for the varying output in a shared pressure line as sensed by a shared load sensing line.

The construction and arrangements of the hydraulic system, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A hydraulic system for a vehicle, comprising:

a first hydraulic circuit, comprising:

a first pump having a flow outlet;

a first pressure line having a pump end coupled to the flow outlet of the first pump; and a first load sensing line having a pump end coupled to the first pump and a pressure end coupled to the first pressure line;

a second hydraulic circuit, comprising:

a second pump having a flow outlet;

a second pressure line having a pump end coupled to the flow outlet of the second pump; and a second load sensing line having a pump end coupled to the second pump and a pressure end coupled to the second pressure line; and a main actuator coupled to the first pressure line and the second pressure line and configured to oppose a load force, wherein the first load sensing line is separate from the second load sensing line such that the first pump and the second pump respond independently to the load force.

2. The hydraulic system of claim 1, further comprising:

a first orifice coupled to the first pressure line; and a second orifice coupled to the second pressure line;

wherein the pressure end of the first load sensing line is coupled to the first pressure line between the first orifice and the main actuator and the pressure end of the second load sensing line is coupled to the second pressure line between the second orifice and the main actuator.

3. The hydraulic system of claim 2, wherein the first hydraulic circuit further comprises a first control valve coupled to the first pressure line between the flow outlet of the first pump and the main actuator; and wherein the second hydraulic circuit further comprises a second control valve coupled to the second pressure line between the flow outlet of the second pump and the main actuator.

4. The hydraulic system of claim 3, wherein the first orifice is disposed within the first control valve and the second orifice is disposed within the second control valve.

5. The hydraulic system of claim 4, further comprising a hydraulic reservoir coupled to at least one of the first hydraulic circuit and the second hydraulic circuit.

6. The hydraulic system of claim 5, further comprising a return line coupling at least one of the first control valve and the second control valve with the hydraulic reservoir.

7. The hydraulic system of claim 6, further comprising a union coupling the first pressure line to the second pressure line between actuator and the first control valve and the second control valve so that the first pressure line and the second pressure line combine flows downstream of the first control valve and the second control valve.

8. A hydraulic system for a vehicle, comprising:

a plurality of pumps configured to provide a pressurized fluid including a first pump and a second pump;

a plurality of pressure lines including a first pressure line coupled to the first pump and defining a first flow path and a second pressure line coupled to the second pump and defining a second flow path;

a plurality of load sensing lines including a first load sensing line and a second load sensing line;

a main actuator in fluid communication with the first pressure line and the second pressure line;

a plurality of control valves including a first control valve disposed along the first flow path and a second control valve disposed along the second flow path; and a union coupling the first pressure line to the second pressure line, wherein the union is positioned along the first flow path and the second flow path between the plurality of control valves and the main actuator so that the first pressure line and the second pressure line combine flows downstream of the first control valve and the second control valve.

9. The hydraulic system of claim 8, wherein the union includes a first inlet coupled to the first pressure line, a second inlet coupled to the second pressure line, and an outlet coupled to the main actuator with a common pressure line.

10. The hydraulic system of claim 9, wherein the first load sensing line includes a pump end coupled to the first pump and a pressure end in fluid communication with the first flow path, and wherein the second load sensing line includes a pump end coupled to the second pump and a pressure end in fluid communication with the second flow path.

11. The hydraulic system of claim 9, wherein the first load sensing line is separate from the second load sensing line such that the first pump and the second pump respond independently to a load force.

12. The hydraulic system of claim 11, wherein the pressure end of the first load sensing line is coupled to the first flow path downstream of the first control valve and upstream of the union, and wherein the pressure end of the second load sensing line is coupled to the second flow path downstream of the second control valve and upstream of the union.

13. A vehicle, comprising:

a chassis;

a driver coupled to the chassis;

a first hydraulic circuit, comprising:

a first pump coupled to the driver and having a flow outlet;

a first pressure line having a pump end coupled to the flow outlet of the first pump; and a first load sensing line having a pump end coupled to the first pump and a pressure end coupled to the first pressure line;

a second hydraulic circuit, comprising:

a second pump coupled to the driver and having a flow outlet;

a second pressure line having a pump end coupled to the flow outlet of the second pump; and a second load sensing line having a pump end coupled to the second pump and a pressure end coupled to the second pressure line; and a main actuator coupled to the first pressure line and the second pressure line and configured to oppose a load force;

wherein the first load sensing line is separate from the second load sensing line such that the first pump and the second pump respond independently to the load force.

14. The vehicle of claim 13, wherein the first hydraulic circuit further comprises a first auxiliary actuator coupled to the first pressure line with a first auxiliary control valve; and wherein the second hydraulic circuit further comprises a second auxiliary actuator coupled to the second pressure line with a second auxiliary control valve.

15. The vehicle of claim 14, further comprising:

a first auxiliary load sensing line coupled to the first auxiliary control valve; and a second auxiliary load sensing line coupled to the second auxiliary control valve;

wherein the first pump and the second pump respond independently to load forces applied to the first auxiliary actuator and the second auxiliary actuator.

16. The vehicle of claim 15, further comprising:

a first control valve positioned to selectively place the first pump in fluid communication with the main actuator; and a second control valve positioned to selectively place the second pump in fluid communication with the main actuator.

17. The vehicle of claim 16, wherein the first control valve and the second control valve each include a limiting position to prohibit flow therethrough thereby decoupling the first pressure line from the second pressure line such that the first hydraulic circuit and the second hydraulic circuit operate entirely independently.

18. The vehicle of claim 14, further comprising:

a body coupled to the chassis, wherein the body includes a plurality of sidewalls that define a collection chamber; and a packer disposed within the collection chamber, wherein the main actuator is coupled to the packer.

19. The vehicle of claim 18, further comprising an arm coupled to the first auxiliary actuator and at least one of a tailgate and a top door coupled to the second auxiliary actuator.

20. The vehicle of claim 19, wherein the first auxiliary actuator engages the arm independent of a load applied to the second auxiliary actuator and the second auxiliary actuator engages at least one of the tailgate and the top door independent of a load applied to the first auxiliary actuator.

* * * * *